United States Patent [19]

Reynoso

[11] 4,416,030

[45] Nov. 22, 1983

[54] COMPACT ADJUSTABLE SPA JET AERATOR

[76] Inventor: Arturo S. Reynoso, 27933 Oakmoor, Canyon County, Calif. 91351

[21] Appl. No.: 431,297

[22] Filed: Sep. 30, 1982

[51] Int. Cl.[3] ..... E04H 3/18; A61H 33/02; E03C 1/02

[52] U.S. Cl. ..... 4/496; 4/541; 4/542; 4/492; 128/66; 239/428.5

[58] Field of Search ..... 4/542, 541, 490, 492, 4/496; 128/66; 239/428.5, 428

[56] References Cited

U.S. PATENT DOCUMENTS

| | | | |
|---|---|---|---|
| 3,890,655 | 6/1975 | Mathis | 128/66 X |
| 3,946,449 | 3/1976 | Mathis | 4/542 |
| 4,264,039 | 4/1981 | Moreland | 4/542 |
| 4,320,541 | 3/1982 | Neenan | 4/542 X |
| 4,335,854 | 6/1982 | Reynoso | 4/542 X |

*Primary Examiner*—Henry K. Artis
*Attorney, Agent, or Firm*—John J. Posta, Jr.

[57] ABSTRACT

An improved more compact type of fully adjustable spa jet water aerator is provided which is simple, inexpensive, durable, easy to install and use and which features easy separate adjustment of water and air flow therethrough. The aerator can be secured within a spa wall with the exit nozzle and controls readily accessible from within the spa. The aerator comprises a molded unitary housing defining an elongated passageway with water and air conduits disposed in stacked relation on the same side of the passageway to conserve space. The passageway extends to the front of the housing. The conducts have openings communicating with the passageway and a concentric pair of sleeves are threaded into the passageway and manually adjustable to align apertures therein with the conduit openings to control the air and water flow into the passageway. Cylindrical preferably ridged seals with alignable apertures are disposed over the rear ends of the sleeves adjacent the sleeve apertures to prevent fluid leakage. The inner sleeve defines an aerating chamber, and a replaceable flow reducer cylinder is disposed adjacent thereto in the inner sleeve.

11 Claims, 7 Drawing Figures

COMPACT ADJUSTABLE SPA JET AERATOR

BACKGROUND OF THE INVENTION

1. Field of the Invention

The present invention generally relates to aerators and more particularly to improved compact adjustable spa jet aerators.

2. Prior Art

Most spa jet aerators are heavy bulky, expensive and difficult to install and maintain. Many new spas are now being placed in areas where low cost and small space are of prime consideration so that such aerators are unsuitable. In many instances, changes in conditions require adjustment of water and air flow through the aerator. However, desired adjustments in aeration are not easy to obtain with conventional aerators.

The aerator set forth in U.S. Pat. No. 4,335,854 is inexpensive, easy to adjust and install and is relatively compact and light in weight. However, greater compactness is desireable. Moreover, some difficulties have been encountered with this device. Thus, air tends to seep past the control members of the aerator and into the mixing or aeration chamber, causing bubbles at a time when the aerator is supposedly shut off. Specifically suction in the aeration chamber creates a vacuum which draws the air into that chamber.

Accordingly, there is a need for an improved spa aerator which has all the advantages of that of U.S. Pat. No. 4,335,854, including low cost, easy adjustability of aeration, etc., but which is not subject to fluid leakage, and also is more compact and has even greater control of aeration.

SUMMARY OF THE INVENTION

The improved compact adjustable spa jet aerator of the present invention satisfies all the foregoing needs. Thus, the aerator is of an improved more compact design, does not leak air or water when shut off and is readily adjustable for pumps of various sizes. The aerator is substantially as set forth in the Abstract above.

The aerator comprises a light weight housing of molded plastic or the like defining an elongated passageway with a front exit, and separate stacked water and air conduits disposed on one side of the passageway. Each conduit contains an opening alignable with an aperture in one of a pair of concentric sleeves adjustable threaded in the passageway and extending out of the front end of the housing to form rings for easy manipulation in adjusting water and air flow.

Flexible cylindrical seals, preferably with spaced external integral rings and traverse ribs, are disposed on the sleeves with apertures therein aligned with the sleeve apertures. The inner sleeve forms an aeration chamber and releasably holds a flow reducer cylinder with an orifice of controlled size which is used to adapt the aerator to different sizes of pumping equipment. Further features are set forth in the following detailed description and accompany of drawings.

DETAILED DESCRIPTION OF THE PREFERRED EMBODIMENT

FIGS. 1–7

Figure 1:
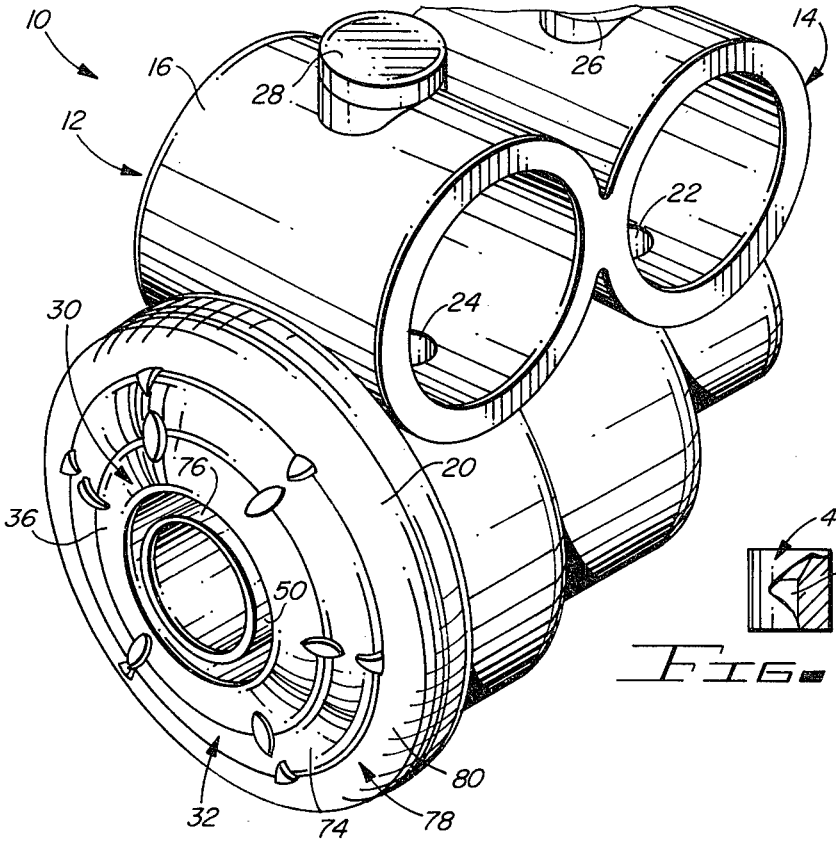
FIG. 1 is a schematic perspective view of a preferred embodiment of the improved spa jet aerator of the present invention.
Figure 5:
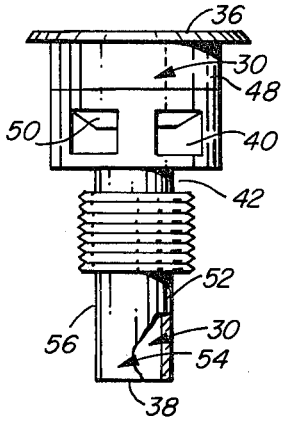
FIG. 5 is a schematic side elevation of the water sleeve of the aerator of FIG. 6 with the seal of the present invention in place thereon.
Figure 7:
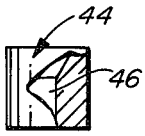
FIG. 7 is a schematic side elevation, partly broken away, of a flow reducer cylinder shown in FIG. 2.
Figure 6:
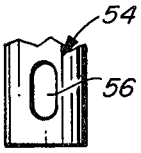
FIG. 6 is a schematic side elevation of the sleeve of FIG. 5.
Figure 4:
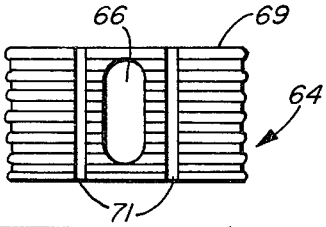
FIG. 4 is a schematic side elevation of the sleeve of FIG. 3.
Figure 3:
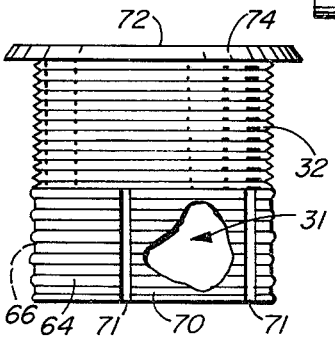
FIG. 3 is a schematic side elevation of the air sleeve of the aerator of FIG. 2, with the seal of the present invention in place thereon.
Figure 2:
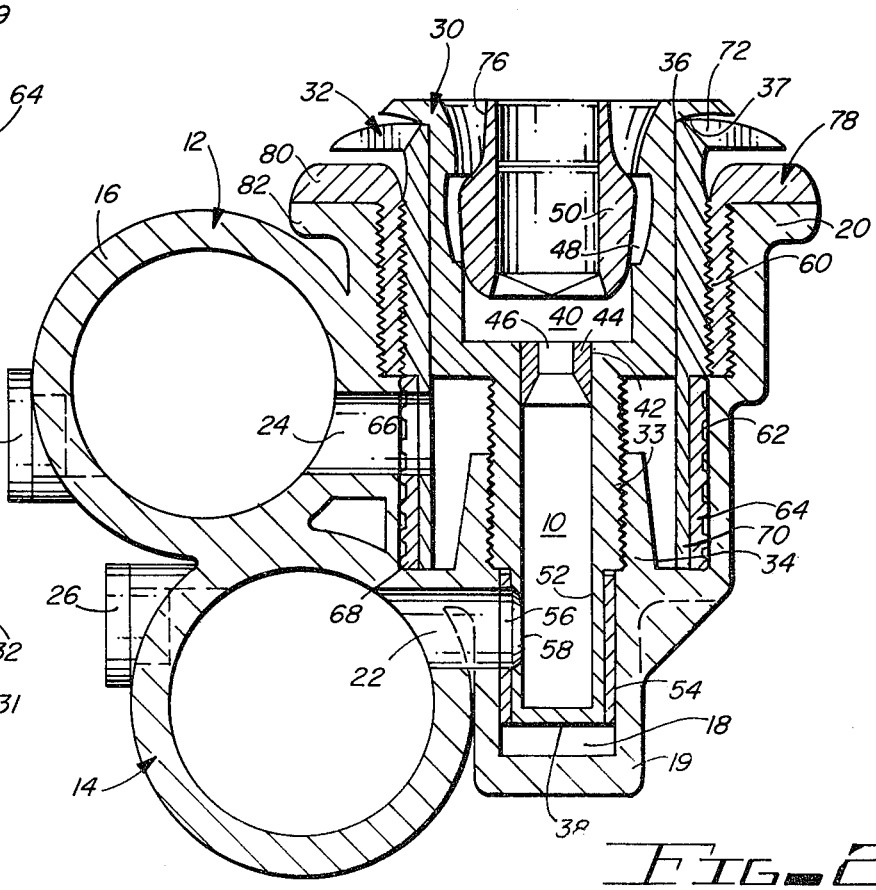
FIG. 2 is a schematic vertical cross section of the aerator of FIG. 1.

Now referring more particularly to FIGS. 1–7 of the drawings, a preferred embodiment of the improved spa jet aerator of the present invention is schematically depicted therein. Thus, aerator 10 is shown (FIGS. 1 and 2) which comprise a hollow housing 12 of metal, ceramic or the like, preferably molded plastic. Housing 12 defines an integral water conduit 14 and an integral air conduit 16 stacked thereagainst on one side of a longitudinal passageway 18 which extends to the rear 19 of housing 12 and which exits at the front 20 of housing 12. Conduit 14 has an opening 22 on its medial side and conduit 16 has an opening 24 on its medial side. Conduit 14 may have an openable plugged access hole 26 on its lateral side and conduit 16 may have an openable plugged access hole 28 on its lateral side (FIG. 2).

A pair of concentric cylindrical sleeves 30 and 32 are threadably releasably disposed in front 20 and adjustably extend into passageway 18, as shown in FIG. 2. Inner sleeve 30 is threaded at its mid portion 33 to the inner surface of a necked down portion 34 in the rear 19 of housing 12 and has an open front end terminating in on annular flange or turn ring 36, and a closed rear end 38.

Sleeve 30 includes a forward, expanded cage-like aeration chamber 40, a throat area 42 behind (upstream) chamber 40 in which is slideably releasably disposed a flow reducer cylinder 44 with restricted orifice 46, and an expanded area 48 in front of aeration chamber 40 within which is seated a rotatable eyeball exit nozzle 50. Nozzle 50 prevents the flow of aerated water from housing 12 except through nozzle 50.

The rear portion 52 of sleeve 30 is unthreaded, and has a flexible resilient cylindrical seal 54 slideably disposed thereon. Seal 54 can be of rubber or plastic or the like and has an oval aperture 56 extending through the sidewall thereof which is of the same size and shape and is aligned with an aperture 58 extending through the sidewall of sleeve 30.

By manually rotating sleeve 30 in passageway 18, as by turning front ring 36, aperture 58 is spiraled with the rest of sleeve 30 into and out of housing 12 and into and out of alignment with opening 22 of water conduit 14 so as to control precisely the flow of water from conduit 14 into aeration chamber 40.

Concentric outer sleeve 32 is threaded in its front portion 60 to housing 12 adjacent from end 20 (FIG. 2) but is unthreaded in its rear portion 62 over which is releasably disposed a flexible resilient cylinder seal 64. Seal 64 has an oval aperture 66 extending through the sidewall thereof aligned with an aperture 68 of the same size and shape and extending through the sidewall of sleeve 32. Seal 64 prevents all leakage of air through housing 12, except desired flow into chamber 40 through sleeve 32. It will be noted that seal 64 preferably has a plurality of spaced parallel rings or ridges 69 perpendicular to the direction of flow of air through sleeve 32. Additional ribs 71 can be provided on seal 64 which extend transverse to ridges 69 at spaced intervals along the outer surface of seal 64. Ridges 69 and/or ribs 71 facilitate air sealing by seal 64 and act as a series of air traps to assure that undesired siphoning or suction of air through housing 12 does not occur.

Sleeve 32 is open at its rear end 70 and front end 72, the latter end terminating in a turn ring 74. Rear end 70 approaches closed rear 19 of housing 12. By manually rotating sleeve 32 in passageway 18, as by turning front ring 74, aperture 68 is spiraled with the rest of sleeve 32 into and out of housing 12 and into and out of alignment with opening 24 of air conduit 16 so as to control precisely the flow of air from conduit 16 into aeration chamber 40. Seal 64 prevents inadvertant leakage of air into and bubbling of water in chamber 40.

It will be understood that concentric rings 36 and 74 are readily manually accessible even when housing 12 is mounted in a spa wall (not shown). So also is the front end 76 of eyeball nozzle 50 for directional flow of aerated water.

Housing 12 includes a cylindrical sleeve clamp 78 threaded to front end 20 of housing 12. Clamp 78 has an annular jaw 80 adapted to abut and clamp the front inner surface of a spa wall, (not shown) and housing 12 has a second annular jaw 82 adapted to abut the outer surface of the spa wall. Clamp 78 can be rotated until the spa wall is tightly gripped between jaws 80 and 82 to hold aerator 10 in place.

During use of aerator 10, a controlled flow of air through conduit 16, opening 24, seal aperture 66, sleeve aperture 68 and sleeve 32 into chamber 40 occurs, while simultaneously a controlled flow of water from conduit 14 through opening 22, seal aperture 56, sleeve aperture 58 and sleeve 30 into chamber 40 occurs.

The water and air continuously mix in chamber 40 so that the water is controllably aerated, the extend of aeration depending on the relative flow rates of air and water, as determined by the settings of rings 36 and 74, the size of orifice 46 of cylinder 44, the pump capacity, the aerated water exits housing 12 through end 76 of nozzle 50 in a manually controlled direction into a spa, usually below the water level. A plurality of aerators 10 can be placed at one or more levels and spaced locations around the periphery of the spa.

Inadvertant undesired air and water bleeding from aerator 10 does not occur, due to the presence of seals 54 and 64, and the ridged and ribbed nature of the exterior of seal 64. Vacuum created in chamber 40 does not result in siphoning of air or water into chamber 40 when aerator 10 is off. Accordingly, aerator 10 is of improved durability and function. A wide range of pump sizes can be used with aerator 10 merely by changing flow reducer cylinder 44 to provide the desired size orifices 46.

It will be understood that, if desired, conduit 14 could be the air conduit and conduit 16 the water conduit without adversely affecting the operation of aerator 10. Inasmuch as aerator 10 is very compact, with conduits 14 and 16 grouped together, a smaller diameter opening than formerly is required to fit aerator 10 into a wall, etc. This is important for applications where space is at a premium. Various other advantages of the improved aerator of the present invention are as set forth in the foregoing.

Various modifications, changes alterations and additions can be made in the improved aerator of the present invention, in its components and in their parameters. All such modifications, changes, alterations and additions as are within the scope of the appended claims form part of the present invention.

What is claimed is:

1. An improved compact adjustable spa jet aerator, comprising, in combination:

(a) a hollow housing having an elongated passageway therein extending to an exit in the exterior surface thereof, said housing defining an air conduit and a water conduit spaced therefrom in stacked relation adjacent to the same side of said passageway, to render said aerator compact and openings in said conduits communicating with said passageway;

(b) separate concentric water adjusting means and air adjusting means, each comprising a cylindrical sleeve with a side aperture therein alignable with one of said conduit openings to control the flow of fluid from said conduit, said sleeve being threadably secured for rotation into and out of said passageway, the inner one of said water and air sleeves defining an aerating chamber in said passageway in communication with said conduits through said conduit openings and apertures; and, (c) flexible resilient seal means secured to the exterior of said sleeves to prevent leakage of water and air from said aerator.

2. The improved adjustable spa jet aerator of claim 1 wherein said aerator includes nozzle means pivotably secured in said aerating chamber adjacent said exit and a flow reducer element comprising a replaceable cylinder having a restricted orifice therein said reducer being releasably disposed adjacent said aerating chamber in said inner sleeve.

3. The improved adjustable spa jet aerator of claim 2 wherein said seal means comprise resilient cylinders secured to the exterior of those portions of said sleeves which define said apertures, said seal cylinders having aperatures aligned with said sleeve apertures.

4. The improved adjustable spa jet aerator of claim 3 wherein at least one of said cylinder seals includes a plurality of integral, resilient, parallel, spaced ridges disposed on the exterior thereof perpendicular to the length of said passageway and adapted to facilitate the sealing action of said seal.

5. The improved adjustable spa jet aerator of claim 4 wherein said exit is at the front end of said aerator and wherein said seal cylinders are disposed on unthreaded rear end portions of said sleeves.

6. The improved adjustable spa jet aerator of claim 5 wherein said inner sleeve is in communication with said water conduit and said outer sleeve is in communication with said air conduit.

7. The improved adjustable spa jet aerator of claim 5 wherein the outer one of said concentric sleeves bears said seal having said spaced parallel ridges therein.

8. The improved adjustable spa jet aerator of claim 7 wherein said aerator comrises molded plastic components and wherein said sleeves terminate at their front ends in concentric finger-adjustable rings for manual control of the proportions of water and air entering said aerating chamber from said conduits.

9. The improved adjustable spa jet aerator of claim 8 wherein said housing is of one piece molded plastic construction and wherein said inner sleeve is sealed at the rear end thereof.

10. The improved adjustable spa jet aerator of claim 9 wherein the rear end of the outer one of said sleeves approximates a portion of said housing which seals the same.

11. The improved adjustable spa jet aerator of claim 4 wherein said one of said cylinder seals has a plurality of ribs on and extending about the outside surface of said cylinder seals, said ribs extending along the length of said seal.

* * * * *